US006695401B1

(12) United States Patent
Noll

(10) Patent No.: US 6,695,401 B1
(45) Date of Patent: Feb. 24, 2004

(54) METAL FRAME GLIDER WITH PREASSEMBLED BENCH PANELS

(76) Inventor: Ronald C. Noll, 32111 Aurora Rd., Solon, OH (US) 44139

( * ) Notice: Subject to any disclaimer, the term of this patent is extended or adjusted under 35 U.S.C. 154(b) by 0 days.

(21) Appl. No.: 10/241,396

(22) Filed: Sep. 11, 2002

(51) Int. Cl.[7] ..... A47D 13/10; A63G 9/00; A47C 3/02; A47C 7/00

(52) U.S. Cl. ..... 297/281; 297/259.3; 297/273; 297/276; 297/280; 297/440.15; 297/452.63

(58) Field of Search ..... 297/281, 282, 297/273, 276, 277, 278, 280, 440.15, 452.63, 259.3

(56) References Cited

U.S. PATENT DOCUMENTS

| | | | | | |
|---|---|---|---|---|---|
| 862,686 | A | * | 8/1907 | Wallace | 297/281 X |
| 862,756 | A | * | 8/1907 | Potter | 297/281 |
| 871,022 | A | * | 11/1907 | Anthony | 297/440.15 X |
| 897,371 | A | * | 9/1908 | Huebner | 297/440.15 |
| 959,085 | A | * | 5/1910 | Virgie | 297/273 X |
| 1,072,906 | A | * | 9/1913 | Bowman et al. | 297/281 X |
| 1,107,341 | A | * | 8/1914 | Oldfield | 297/273 X |
| 1,159,069 | A | * | 11/1915 | Motznik | 297/281 |
| 1,177,899 | A | * | 4/1916 | Rogers | 297/280 |
| 1,260,358 | A | * | 3/1918 | Fox et al. | 297/281 X |
| 1,266,129 | A | * | 4/1918 | Killman | 297/281 X |
| 1,271,453 | A | * | 7/1918 | Elzey | 297/281 X |
| 1,271,383 | A | * | 9/1918 | Street | 297/281 X |
| 1,325,358 | A | * | 12/1919 | Elzey | 297/281 |
| 1,325,359 | A | * | 12/1919 | Elzey | 297/281 X |
| 1,328,181 | A | * | 1/1920 | Miller | 297/281 X |
| 1,361,700 | A | * | 12/1920 | Elzey | 297/277 X |
| 1,396,774 | A | * | 11/1921 | Neiswender | 297/276 X |
| 1,417,443 | A | * | 5/1922 | Baugher et al. | 297/280 |
| 2,929,076 | A | * | 3/1960 | Ake et al. | 297/440.15 X |
| 3,994,468 | A | | 11/1976 | Carter et al. | |
| 4,213,650 | A | | 7/1980 | Sroub | |
| D259,308 | S | | 5/1981 | Sroub | |
| D287,910 | S | | 1/1987 | Schlarb | |
| D290,911 | S | | 7/1987 | Pomeroy et al. | |
| D298,490 | S | | 11/1988 | Pomeroy et al. | |
| 4,796,949 | A | | 1/1989 | Boyce | |
| D307,361 | S | | 4/1990 | Pomeroy et al. | |
| D307,362 | S | | 4/1990 | Pomeroy et al. | |
| D307,363 | S | | 4/1990 | Pomeroy et al. | |
| D307,523 | S | | 5/1990 | Pomeroy et al. | |
| D310,604 | S | | 9/1990 | Pomeroy et al. | |
| 5,058,951 | A | * | 10/1991 | Thiel | 297/273 |
| D325,823 | S | | 5/1992 | Pomeroy et al. | |
| D328,197 | S | | 7/1992 | Braxton, III | |
| D328,821 | S | | 8/1992 | Wooding et al. | |
| D334,485 | S | | 4/1993 | Pomeroy et al. | |
| D336,788 | S | | 6/1993 | Vasquez | |
| D349,818 | S | | 8/1994 | Noll | |
| D350,855 | S | | 9/1994 | Pomeroy et al. | |
| D360,312 | S | | 7/1995 | Lee | |
| D361,673 | S | | 8/1995 | Pomeroy et al. | |
| D362,349 | S | | 9/1995 | Pomeroy et al. | |
| D365,692 | S | | 1/1996 | Pomeroy et al. | |
| 5,667,273 | A | | 9/1997 | Noll | |
| D399,064 | S | | 10/1998 | Noll | |
| D399,065 | S | | 10/1998 | Noll | |
| D400,720 | S | | 11/1998 | Pomeroy et al. | |
| D403,516 | S | | 1/1999 | Noll | |
| D406,948 | S | | 3/1999 | Noll | |
| D410,340 | S | | 6/1999 | Pomeroy et al. | |

(List continued on next page.)

FOREIGN PATENT DOCUMENTS

| | | | | |
|---|---|---|---|---|
| DE | 3639474 A1 | * | 5/1988 | 297/276 |
| FR | 2676631 A1 | * | 11/1992 | 297/281 |

*Primary Examiner*—Rodney B. White
(74) *Attorney, Agent, or Firm*—Pearne & Gordon LLP

(57) ABSTRACT

A metal frame glider having preassembled wooden seat panels. A bench back panel and a bench seat panel each include three vertical wooden support members to which a plurality of horizontal wooden slats are attached.

14 Claims, 2 Drawing Sheets

U.S. PATENT DOCUMENTS

| | | | | | |
|---|---|---|---|---|---|
| D417,559 | S | | 12/1999 | Pomeroy et al. | |
| D423,801 | S | | 5/2000 | Noll | |
| 6,120,094 | A | * | 9/2000 | Parent | 297/281 X |
| D432,323 | S | | 10/2000 | Pomeroy et al. | |
| D434,573 | S | | 12/2000 | Noll | |
| 6,199,950 | B1 | | 3/2001 | Noll | |
| D443,425 | S | | 6/2001 | Pomeroy et al. | |
| D444,306 | S | | 7/2001 | Jaisinghani | |
| D444,635 | S | | 7/2001 | Noll | |
| D449,454 | S | | 10/2001 | Pomeroy et al. | |
| D450,193 | S | | 11/2001 | Pomeroy et al. | |
| D450,937 | S | | 11/2001 | Pomeroy et al. | |

* cited by examiner

FIG. 1A
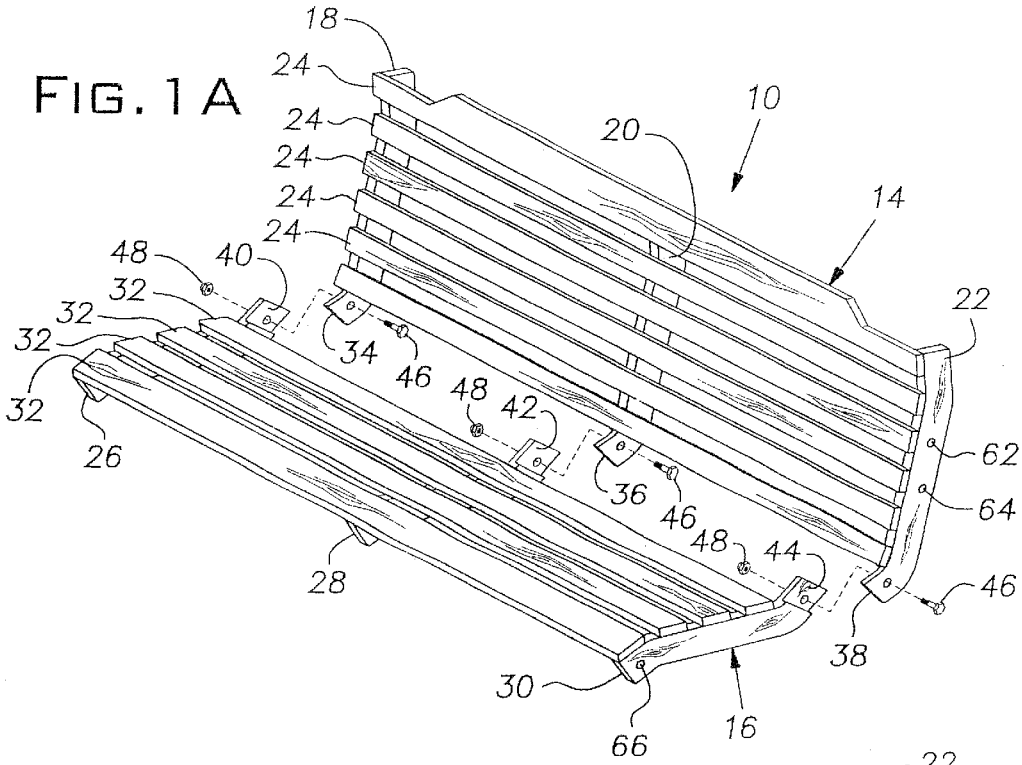
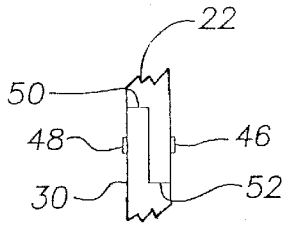
FIG. 1C
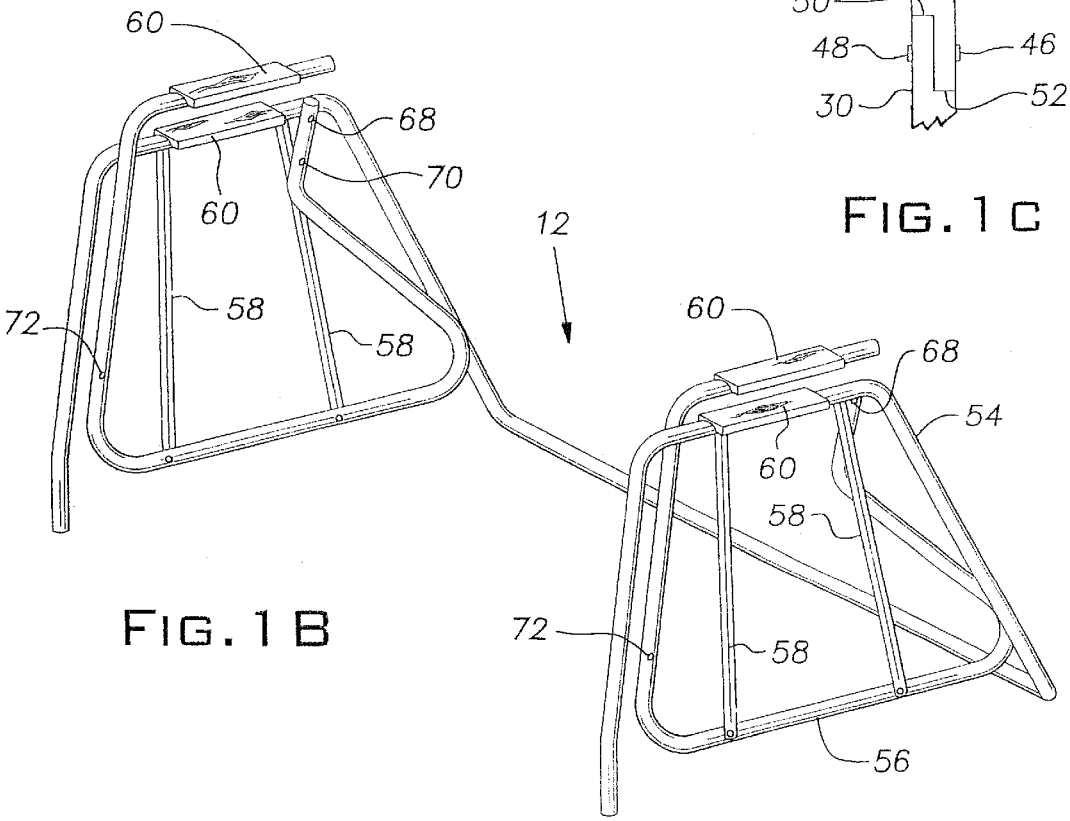
FIG. 1B

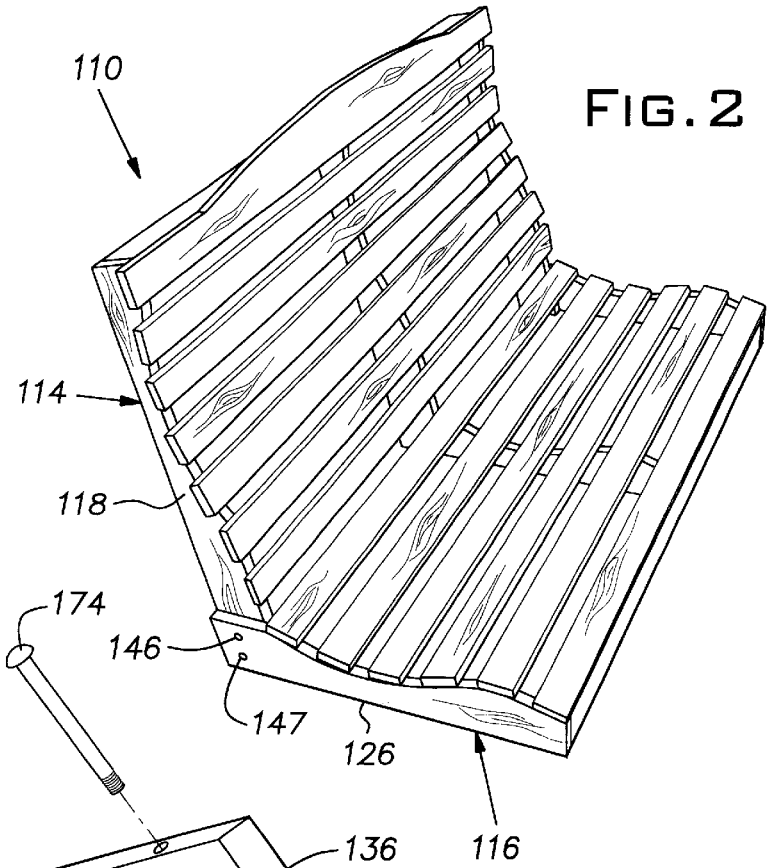
FIG. 2
FIG. 3A
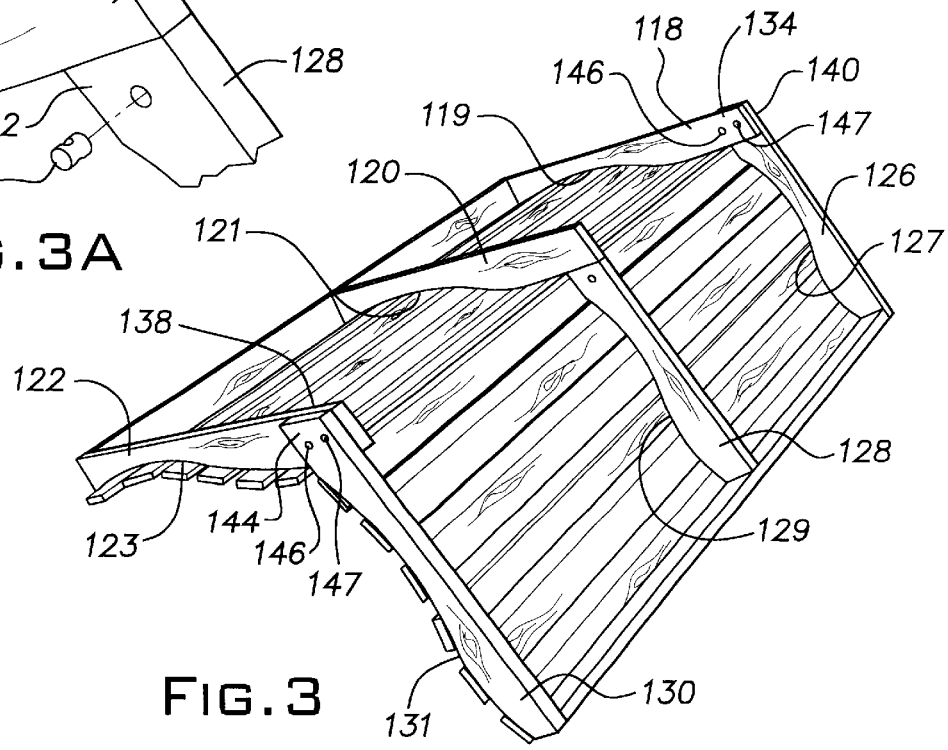
FIG. 3

METAL FRAME GLIDER WITH PREASSEMBLED BENCH PANELS

BACKGROUND OF THE INVENTION

The present invention relates to a glider, and more particularly to a glider having preassembled bench panels.

Gliders, also referred to as swings, are lawn or porch furniture providing single or multiple person seating that is generally suspended so that it may rock or swing. Conventionally, gliders are sold to consumers in an unassembled condition because it is impractical to package, store and transport these bulky items in an assembled condition.

A particularly popular form of gliders include a bench with seat and back portions each having a plurality of horizontal wooden slats. This type of glider often includes a frame fabricated from solid metal or metal tube stock, or cast from metal. As compared to wooden frames, such metal frames are durable, lightweight and relatively inexpensive to manufacture.

Assembly of such a glider involves individually attaching each wooden slat to the metal frame using two or more screws, nuts and bolts, or similar fasteners. This is inconvenient for a purchaser of the glider since it is a very tedious and time consuming task. Further, such an involved assembly procedure by an unskilled consumer often leads to improperly assembled gliders.

Thus, it is desirable to produce a glider with wooden seat slats that is easy to assemble and can be provided to the consumer in a compact package.

SUMMARY OF THE INVENTION

The present invention provides a partially assembled glider for final assembly by a purchaser comprising: a stationary frame; a bench frame for suspended attachment to the stationary frame; a preassembled bench back panel for attachment to the bench frame, the preassembled bench back panel comprising a first plurality of slats secured to a first support; and a preassembled bench seat panel for attachment to the bench frame, the preassembled bench seat panel comprising a second plurality of slats secured to a second support.

According another aspect, the present invention provides a glider comprising: a stationary frame formed from metal; a bench frame formed from metal, the bench frame being movably suspended from the stationary frame; a bench back panel comprising a first plurality of wooden slats attached to a first wooden support, the bench back panel being attached to the bench frame; and a bench seat panel comprising a second plurality of wooden slats attached to a second wooden support, the bench seat panel being attached to the bench frame.

According to a further aspect, the present invention provides a method for manufacturing a partially assembled glider for final assembly by a purchaser, the method comprising steps of: assembling a bench back panel by securing a first plurality of slats to a first support; assembling a bench seat panel by securing a second plurality of slats to a second support; fabricating a plurality of frame members for constructing a bench frame and a stationary frame; and packaging the bench back panel, the bench seat panel and the frame members unassembled in a package for storage, shipping and sale to a consumer.

BRIEF DESCRIPTION OF THE SEVERAL VIEWS OF THE DRAWING

FIG. 1A is an exploded perspective view of a bench for a glider assembly according to a first embodiment of the present invention;

FIG. 1B is a perspective view of a frame for a glider assembly according to the first embodiment of the present invention;

FIG. 1C is a detail view of a lap joint of the bench of FIG. 1A;

FIG. 2 is a perspective view of a bench for a glider assembly according to a second embodiment of the present invention;

FIG. 3 is a bottom perspective view of the bench of FIG. 2; and

FIG. 3A is a detail view of a joint of the bench of FIG. 2.

DETAILED DESCRIPTION OF THE INVENTION

According to a first embodiment of the present invention, as shown in FIGS. 1A and 1B, a glider assembly in a partially assembled condition comprises a bench 10 and a frame 12. The bench 10 comprises a preassembled bench back panel 14 and a bench seat panel 16.

The bench back panel 14 comprises a left side support member 18, an intermediate support member 20, a right side support member 22, and a plurality of slats 24 attached to the support members 18–22. Likewise, the bench seat panel 16 comprises a left side support member 26, an intermediate support member 28, a right side support member 30, and a plurality of slats 32 attached to the support members 26–30.

The support members 18–22, 26–30 and the slats 24, 32 are each fabricated from wood. The slats 24, 32 are attached to the respective support members 18–22, 26–30 by a manufacturer using nails, brads, rivets, screws, adhesive or other known means of attachment. Thus, the bench back panel 14 and the bench seat panel 16 are provided to a purchaser of the glider in an individually preassembled condition.

The glider assembly is provided to a purchaser by the manufacturer or retailer in the form of a packaged kit, which includes the preassembled bench back panel 14, the preassembled bench seat panel 16, the frame 12, and a variety of fasteners and other hardware necessary for final assembly of the glider by the purchaser.

The bench back panel 14 and the bench seat panel 16 are each provided with means of attachment for attaching the panels 14, 16 to each other. The means of attaching the bench back panel 14 comprises notched ends 34, 36, 38 provided respectively to each of the support members 18–22. Likewise, the means of attaching the bench seat panel 16 comprises notched ends 40, 42, 44 provided respectively to each of the support members 26–30.

To assemble the bench 10, the purchaser of the glider attaches the notched ends 34–38 of the bench back panel 14 to the respective and complementary notched ends 40–44 of the bench seat panel 16 using nuts 46 and bolts 48. The resulting joint is similar to that commonly referred to as a square shoulder joint or lap joint. As shown in FIG. 1C, each pair of complementary notched ends 34,40; 36,42; 38,44 are engaged such that relative rotation is prevented by the abutment of pairs of shoulders or facing surfaces 50, 52.

The glider frame 12 comprises a stationary frame 54 and a bench frame 56. In the disclosed embodiment, the frames 54, 56 are fabricated from bent metal tube stock. Alternatively, other material could be used to fabricate the frames 54, 56, such as solid metal stock. The bench frame 56 is movably suspended from the stationary frame 54 by a plurality of glider bands or straps 58 attached between the frames 54, 56. This attachment can be achieved by a bushing and fastener assembly, or similar, utilized at each point of attachment of the glider straps 58. The straps 58 of the present embodiment are in the form of metallic straps, however, other suitable materials or other suitable configurations can be utilized. For example, although the glider frame 12 of the present embodiment is shown to utilize two straps 58 on each side of the frame 12, a lesser or greater number can be used and/or the straps 58 can be formed from an elastomeric material.

The glider frame 12 can be provided to the consumer in various stages of assembly. For example, each of the stationary frame 54, the bench frame 56 and the glider straps 58 can be provided as separate parts to be assembled by the purchaser. As a further example, the stationary frame 54 and/or the bench frame 56 can be provided as smaller sections of metal tubing (not shown) which must be fastened together by the purchaser to form the frames 54, 56.

Each of the stationary frame 54 and the bench frame 56 has a pair of armrests 60 attached thereto. The armrests 60 can be provided pre-attached to the purchaser or as separate parts which must be attached using fasteners. Alternatively, one or more of the armrests 60 can be eliminated. As a further alternative, other structures can be substituted for the armrests 60, such as side tables.

To enable the purchaser to attach the assembled bench 10 to the frame 12, each side of the bench 10 is provided with a plurality of holes: a first attachment hole 62 and a second attachment hole 64 in each of the left and right side support members 18, 22 of the bench back panel 14, and a third attachment hole 66 in each of the left and right side support members 26, 30 of the bench seat panel 16. A screw, bolt or other fastener (not shown) is used to secure each of these attachment holes 62–66 to corresponding holes 68, 70, 72 in the bench frame 56 by the purchaser.

FIGS. 2, 3 and 3A show a glider bench 110 according to a second embodiment of the present invention. Like the bench 10 of the first embodiment, the bench 110 comprises a bench back panel 114 and a bench seat panel 116. Support members 118, 120, 122, 126, 128, 130 are respectively provided with curved support surfaces 119, 121, 123, 127, 129, 131, resulting in a curved arrangement of the attached slats 124, 132. This curved arrangement of the slats 124, 132 is provided to enhance the comfort and aesthetic appeal of the bench 110.

As shown in FIGS. 2 and 3, the left side support members 122, 130 overlap at their respective ends 138, 144 and are attached to each other by means of two screws, bolts or other fasteners 146, 147. The use of two fasteners 146, 147, unlike the single fastener 46 of the first embodiment, prevents relative rotation of the support members 122, 130. Similarly, the right side support members 118, 126 overlap at their respective ends 134, 140 and are attached to each other by means of two fasteners 146, 147.

As best shown in FIG. 3A, the intermediate support members 120, 128 abut at their respective ends 136, 142 and are attached to each other by means of a bolt 174 and cylindrical nut 176. This type of joint is commonly referred to as a butt joint. Other means of attachment, such as a wood screw or peg, could be used in place of the bolt 174 and cylindrical nut 176.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A partially assembled glider for final assembly by a purchaser comprising:

a stationary frame;

a bench frame for suspended attachment to the stationary frame;

a preassembled bench back panel for attachment to the bench frame, the preassembled bench back panel comprising a first plurality of slats secured to a first support;

a preassembled bench seat panel for attachment to the bench frame, the preassembled bench seat panel comprising a second plurality of slats secured to a second support; and an attachment means for attaching the preassembled bench back panel to the preassembled bench seat panel, the attachment means comprising:

a first notched end of the first support of the preassembled bench back panel; and a second notched end of the second support of the preassembled bench seat panel, the second notched end for engagement with the first notched end.

2. The glider of claim 1, wherein the attachment means further comprises:

a first planar surface of the first support of the preassembled bench back panel; and a second planar surface of the second support of the preassembled bench seat panel, the second planar surface for abutting engagement with the first planar surface.

3. The glider of claim 1, wherein the first plurality of slats, the second plurality of slats, the first support and the second support are each fabricated from wood and wherein the stationary frame and the bench frame are each fabricated from metal.

4. The glider of claim 1, wherein the first plurality of slats are secured to a curvilinear surface of the first support.

5. The glider of claim 1, wherein the second plurality of slats are secured to a curvilinear surface of the second support.

6. A glider comprising:

a stationary frame formed from metal;

a bench frame formed from metal, the bench frame being movably suspended from the stationary frame;

a bench back panel comprising a first plurality of wooden slats attached to a wooden support, the bench back panel being attached to the bench frame; and a bench seat panel comprising a second plurality of wooden slats attached to a second wooden support, the bench seat panel being attached to the bench frame; and an attachment means for attaching the bench pack panel to the bench seat panel, the attachment means comprising:

a first notched end of the first wooden support of the bench back panel; and a second notched end of the second wooden support of the bench seat panel, the second notched end for engagement with the first notched end.

7. The glider of claim 6, wherein the attachment means further comprises:

a first planar surface of the first wooden support of the bench back panel; and a second planar surface of the second wooden support of the bench seat panel, the second planar surface for abutting engagement with the first planar surface.

8. The glider of claim 6, wherein the first plurality of wooden slats are secured to a curvilinear surface of the first wooden support.

9. The glider of claim 6, wherein the second plurality of wooden slats are secured to a curvilinear surface of the second wooden support.

10. The glider of claim 6, wherein the first wooden support comprises a first plurality of elongated support members secured transversely to the first plurality of wooden slats.

11. The glider of claim 6, wherein the second wooden support comprises a second plurality of elongated support members secured transversely to the second plurality of wooden slats.

12. A method for manufacturing a partially assembled glider for final assembly by a purchaser, the method comprising steps of:

assembling a bench back panel by securing a first plurality of slats to a first support;

assembling a bench seat panel by securing a second plurality of slats to a second support;

fabricating a plurality of frame members for constructing a bench frame and a stationary frame; and packaging the bench back panel, the bench seat panel and the frame members unassembled in a package for storage, shipping and sale to a consumer;

wherein the first support comprises a first notched end, and the second support comprises a second notched end, the second notched end for engagement with the first notched end.

13. The method according to claim 12, wherein the first support comprises a first planar surface, and wherein the second support comprises a second planar surface, the second planar surface for abutting engagement with the first planar surface.

14. The method according to claim 12, wherein the first plurality of slats, the second plurality of slats, the first support and the second support are each fabricated from wood and wherein the plurality of frame members are fabricated from metal.

* * * * *